US009434158B2

(12) United States Patent
Houjou

(10) Patent No.: US 9,434,158 B2
(45) Date of Patent: Sep. 6, 2016

(54) INKJET RECORDING DEVICE

(71) Applicant: FUJIFILM Corporation, Tokyo (JP)

(72) Inventor: Hiroaki Houjou, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/017,032

(22) Filed: Feb. 5, 2016

(65) Prior Publication Data

US 2016/0152047 A1 Jun. 2, 2016

Related U.S. Application Data

(63) Continuation of application No. PCT/JP2014/069772, filed on Jul. 28, 2014.

(30) Foreign Application Priority Data

Sep. 13, 2013 (JP) ..... 2013-190741

(51) Int. Cl.
*B41J 29/393* (2006.01)
*B41J 2/045* (2006.01)
*B41J 11/00* (2006.01)

(52) U.S. Cl.
CPC ..... *B41J 2/04553* (2013.01); *B41J 11/002* (2013.01); *B41J 11/0015* (2013.01)

(58) Field of Classification Search
CPC ... B41J 2/04553; B41J 11/0015; B41J 11/002
See application file for complete search history.

(56) References Cited

U.S. PATENT DOCUMENTS

2005/0253912 A1* 11/2005 Smith ..... B41J 2/04553 347/102
2011/0210995 A1* 9/2011 Fujinaga ..... B41J 29/393 347/9

FOREIGN PATENT DOCUMENTS

| | | | |
|---|---|---|---|
| JP | 2001-058398 | A | 3/2001 |
| JP | 2003-191452 | A | 7/2003 |
| JP | 2004-034643 | A | 2/2004 |
| JP | 2006-240009 | A | 9/2006 |
| JP | 2012-192596 | A | 10/2012 |

OTHER PUBLICATIONS

Written Opinion of PCT/JP2014/069772 mailed Oct. 28, 2014.
International Search Report of PCT/JP2014/069772 mailed Oct. 28, 2014.

* cited by examiner

*Primary Examiner* — Julian Huffman
(74) *Attorney, Agent, or Firm* — Studebaker & Brackett PC

(57) ABSTRACT

An inkjet recording device includes an image forming section that records an image by applying ink, a heating-drying processing section that dries ink droplets applied to the sheet P, a sensor that is provided on a downstream side of the image forming section in the conveying direction and detects an ambient temperature outside the heating-drying processing section in the device, and a control unit that controls the ambient temperature outside the heating-drying processing section in the device. In the case where the ambient temperature is in a target range, the control unit switches the inkjet recording device to a recording mode in which set temperature of the heating-drying processing section is used as a target value corresponding to the time of recording from a standby mode in which set temperature of the heating-drying processing section is used as a target value corresponding to the time of standby.

20 Claims, 7 Drawing Sheets

INKJET RECORDING DEVICE

CROSS-REFERENCE TO RELATED APPLICATIONS

This application is a Continuation of PCT International Application No. PCT/JP2014/069772 filed on Jul. 28, 2014, which claims priority under 35 U.S.C §119 (a) to Japanese Patent Application No. 2013-190741 filed on Sep. 13, 2013. Each of the above application(s) is hereby expressly incorporated by reference, in its entirety, into the present application.

BACKGROUND OF THE INVENTION

1. Field of the Invention

The present application relates to an inkjet recording device that records an image by applying ink droplets to a recording medium.

2. Description of the Related Art

There is an image recording device that prevents change in viscosity of ink present in a nozzle by maintaining a constant ambient temperature in the vicinity of a recording section in a device (see JP2006-240009A). Further, there is an image recording device that controls ambient temperature in the vicinity of the surface, through which a recording medium passes, of a heating-fixing section by controlling the ON/OFF state of a heater element and the amount of heat generated from the heater element (see JP2004-034643A). Furthermore, there is an image recording device that detects ambient temperature in a chamber room covering a carriage on which a recording head for discharging ultraviolet curable ink is mounted and controls the ambient temperature by controlling an electric heater or a fan (see JP2012-192596A).

SUMMARY OF THE INVENTION

An influence of environmental temperature behind the recording section is not considered in the structure disclosed in JP2006-240009A. Further, the structure disclosed in JP2004-034643A is to control the ambient temperature in the heating-fixing section, and the ambient temperature at a position other than the heating-fixing section is not considered. Furthermore, the structure disclosed in JP2012-192596A is to appropriately maintain the viscosity of ink by managing the temperature in the vicinity of the recording section, and an influence of environmental temperature behind the recording section in the device is not considered.

That is, the ambient temperature in the recording device, particularly, the ambient temperature at a position other than the inside of a drying section and a fixing section provided with heat sources is not under control and is not maintained constant. For this reason, there is a problem in that ink drying properties of a recording medium may vary.

The invention has been made in consideration of the above-mentioned circumstances, and an object of the invention is to provide an inkjet recording device that maintains constant ink drying properties of a recording medium.

An inkjet recording device according to a first aspect of the invention includes a drawing unit that records an image by applying ink droplets to a recording medium, a drying unit that is provided on a downstream side of the drawing unit in a conveying direction and dries the ink droplets applied to the recording medium, a detection unit that is provided on a downstream side of the drawing unit in the conveying direction and detects an ambient temperature outside the drying unit in the device, and a control unit that controls the ambient temperature outside the drying unit in the device and switches the inkjet recording device to a recording mode in which a set temperature of the drying unit is used as a target value corresponding to time of recording from a standby mode in which a set temperature of the drying unit is used as a target value corresponding to time of standby in the case where the ambient temperature reaches a target range.

According to the invention, the control unit controls the in-device ambient temperature detected by the detection unit, and the device is switched to a state in which the recording operation can be performed in a state in which the ambient temperature at a position other than the inside of the drying unit and the inside of the fixing unit is in a constant target range. Accordingly, it is possible to maintain constant ink drying properties of the recording medium to which ink has been applied.

According to a second aspect of the invention, in the inkjet recording device, the detection unit is provided between the drawing unit and the drying unit.

According to the invention, the control unit controls the in-device ambient temperature detected by the detection unit between the drawing unit and the drying unit. Accordingly, it is possible to maintain constant ink drying properties of the recording medium to which ink has been applied.

According to a third aspect of the invention, in the inkjet recording device, the detection unit is provided on a downstream side of the drying unit in a conveying direction.

According to the invention, the control unit controls the in-device ambient temperature detected by the detection unit on the downstream of the drying unit. Accordingly, it is possible to maintain constant ink drying properties of the recording medium to which ink has been applied.

According to a fourth aspect of the invention, in the inkjet recording device, the ambient temperature is detected even during a temperature raising operation performed after the inkjet recording device is switched to the recording mode, and a recording operation is started after the ambient temperature enters a target range.

According to the invention, it is possible to prevent overshoot in which the in-device ambient temperature exceeds a target temperature at the time of completion of the switching of the inkjet recording device to the recording mode due to an increase in the amount of heat emitted from a heat source (the drying unit or the like) at the time of cycle-up. Accordingly, it is possible to maintain constant ink drying properties of the recording medium to which ink has been applied.

According to a fifth aspect of the invention, the inkjet recording device further includes a heater for raising the ambient temperature in the recording device.

According to the invention, since it is possible to raise the in-device ambient temperature regardless of the amount of heat emitted from a heat source such as the drying unit, it is possible to maintain constant ink drying properties of the recording medium while preventing the heating of the heat source.

According to a sixth aspect of the invention, the inkjet recording device further includes at least one of an air intake unit that takes external air into the device and an exhaust unit that discharges air to the outside from the inside of the inkjet recording device. The control unit controls at least one of the amount of air taken in by the air intake unit and the amount of air discharged by the exhaust unit in a case in which the ambient temperature is not in the target range.

According to the invention, in a case in which the ambient temperature is higher than the target range, the inside of the device is ventilated by at least one of the air intake unit and the exhaust unit so that the ambient temperature is lowered. In a case in which the ambient temperature is lower than the target range, the air flow rate of at least one of the air intake unit and the exhaust unit is reduced so that heat in the device is retained to raise the ambient temperature. Accordingly, it is possible to maintain constant ink drying properties of the recording medium to which ink has been applied.

According to a seventh aspect of the invention, the inkjet recording device further includes a fixing unit that is provided on the downstream side of the drying unit in the conveying direction and performs processing for fixing the image by the irradiation of ultraviolet rays. In the case where the ambient temperature is in the target range, the control unit switches the inkjet recording device to a recording mode in which a set intensity of the fixing unit is used as a target value corresponding to the time of recording from a standby mode in which a set intensity of the fixing unit is used as a target value corresponding to the time of standby.

According to the invention, fixing processing is performed in a state in which the in-device ambient temperature is controlled on the downstream side of the drawing unit. Accordingly, it is possible to maintain constant ink drying properties of the recording medium.

According to an eighth aspect of the invention, in the inkjet recording device, the detection unit is provided on a downstream side of the fixing unit in the conveying direction.

According to the invention, the control unit controls the in-device ambient temperature detected by the detection unit on the downstream of the fixing unit. Accordingly, it is possible to maintain constant ink drying properties of the recording medium that has been subjected to fixing processing.

According to a ninth aspect of the invention, in the inkjet recording device, the control unit controls at least one of the set temperature of the drying unit and the set intensity of the fixing unit in a case in which the ambient temperature is not in the target range.

According to the invention, in a case in which the ambient temperature is not in the target range, the set temperature or the intensity of heating in the device is controlled by at least one of the drying unit and the fixing unit. In the case where the ambient temperature is lower than the target range, the set temperature or the set intensity of the heat source is increased so that temperature rises. In the case where the ambient temperature is higher than the target temperature, the set temperature or the set intensity of the heat source is reduced so that temperature is lowered. Accordingly, it is possible to maintain constant ink drying properties of the recording medium to which ink has been applied.

According to a tenth aspect of the invention, in the inkjet recording device, in a case where the last recording medium on which the image has been recorded is conveyed from the drying unit or the fixing unit, the control unit changes the set temperature of the drying unit and the set intensity of the fixing unit to settings that correspond to the time of the standby mode.

According to the invention, in the case where the set temperature of the drying unit and the set intensity of the fixing unit, which are obtained after processing for the last recording medium has ended, are used as settings that correspond to the time of the standby mode, the temperature in the device is lowered. Accordingly, it is possible to prevent extra heat from remaining in the device, so that it is possible to prevent the ambient temperature from rising.

According to the above-mentioned structure, the invention can provide an inkjet recording device that maintains constant drying properties of a recording medium.

DESCRIPTION OF THE PREFERRED EMBODIMENTS

First Embodiment (Entire Structure)

Figure 1:
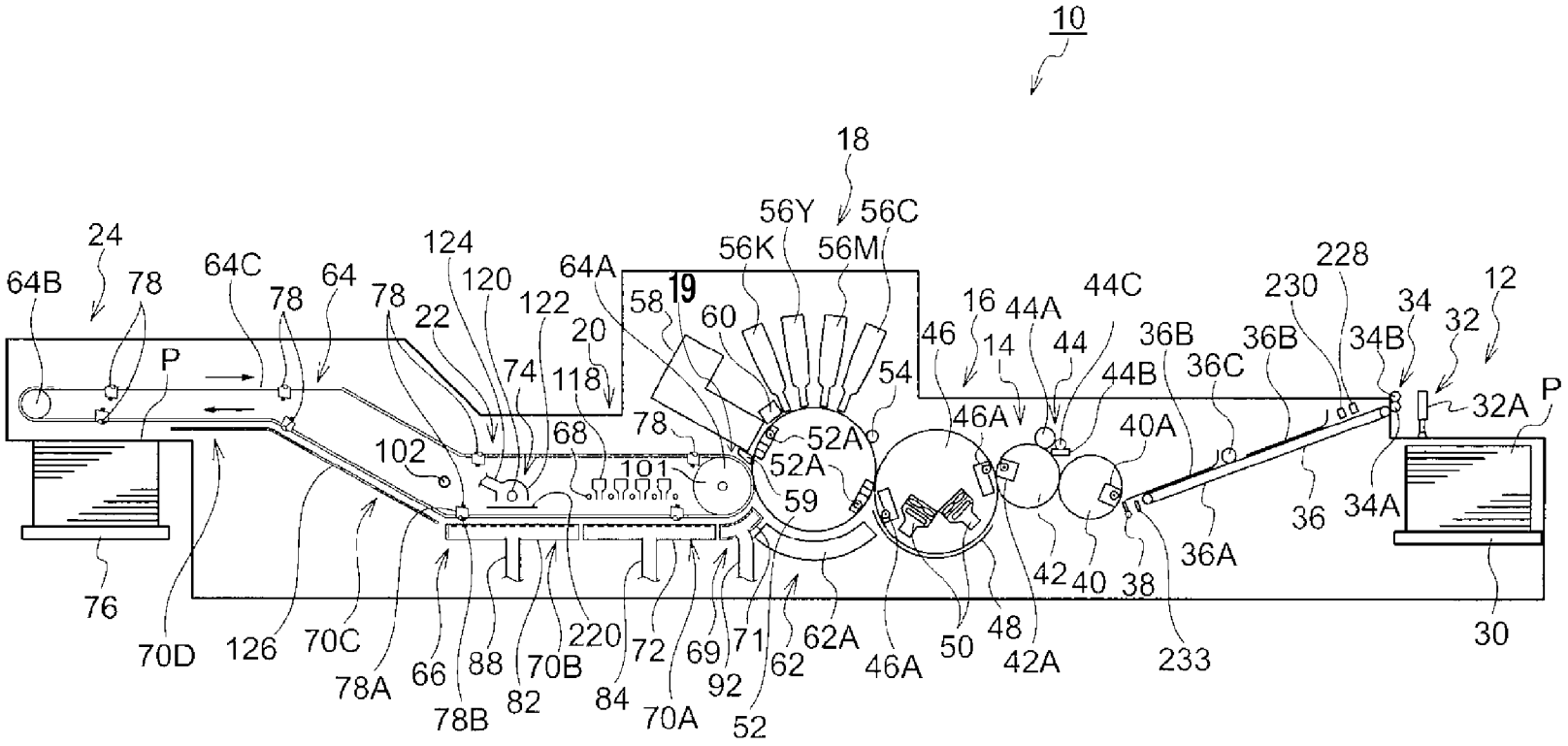
FIG. 1 is a side view of an inkjet recording device according to a first embodiment of the invention.

FIG. 1 is a view showing the entire structure of a first embodiment of an inkjet recording device as an image recording device according to the invention.

The inkjet recording device 10 is an inkjet recording device that records an image on a sheet (recording medium) P with aqueous UV ink (UV (ultraviolet) curable ink using an aqueous medium) by an inkjet method. The inkjet recording device 10 mainly includes: a sheet feed section 12 that feeds the sheet P; a treatment liquid applying section 14 that applies predetermined treatment liquid to the surface (drawing surface) of the sheet P fed from the sheet feed section 12; a treatment liquid drying processing section 16 that performs processing for drying the sheet P to which the treatment liquid has been applied by the treatment liquid applying section 14; an image forming section 18 that forms an image on the surface of the sheet P, which has been subjected to drying processing by the treatment liquid drying processing section 16, with aqueous UV ink by an inkjet method; a delivery section 19 that conveys the sheet P on which the image has been recorded by the image forming section 18 to a heating-drying processing section 20 to be described below; a heating-drying processing section 20 that performs processing for drying the sheet P on which the image has been recorded by the image forming section 18; a UV irradiation processing section 22 that fixes the image to the sheet P by irradiating the sheet P, which has been subjected to drying processing by the heating-drying processing section 20, with ultraviolet rays (UV rays); and a sheet discharge section 24 that discharges the sheet P irradiated with UV rays by the UV irradiation processing section 22.

Figure 2:
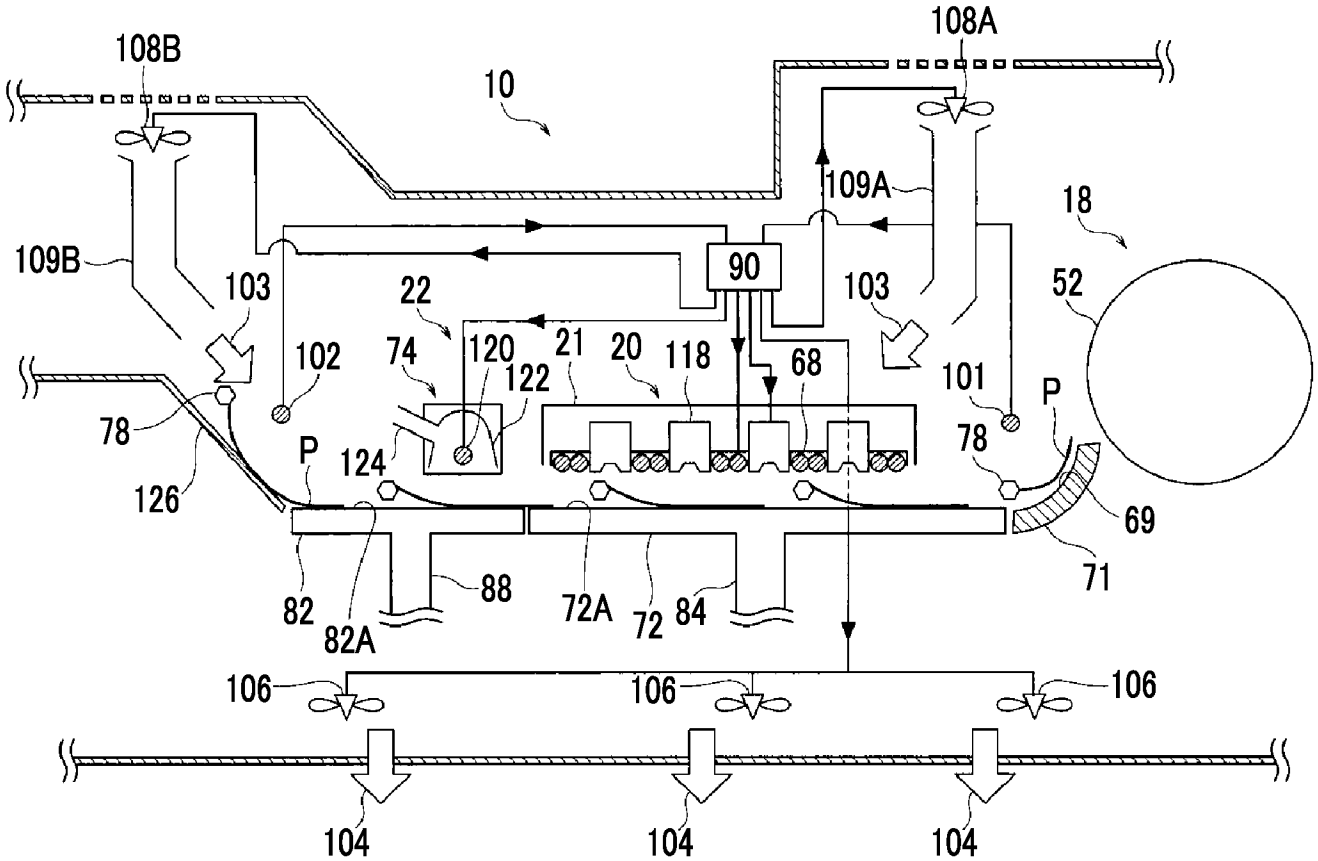
FIG. 2 is an enlarged cross-sectional view showing the vicinity of an image forming section, a heating-drying processing section, and a UV irradiation processing section of the inkjet recording device shown in FIG. 1.

Further, a control unit 90 that controls the sheet feed section 12, the treatment liquid applying section 14, the treatment liquid drying processing section 16, the image forming section 18, the delivery section 19, the heating-drying processing section 20, the UV irradiation processing section 22, and the sheet discharge section 24 is provided as shown in FIG. 2. The control unit 90 controls the inkjet recording device 10; and starts, operates, sets, and stops the device by an operator's operation. The installation position of the control unit 90 is not particularly limited. However, since the control unit 90 is formed of a substrate on electronic components are mounted, it is preferable that the control unit 90 avoids the vicinity of heat sources, such as the heating-drying processing section 20 and the UV irradiation processing section 22, or a high-temperature portion, such as an upper end of the device, and is provided next to an easily accessible portion, such as a back plate or a floor panel.

(Sheet Feed Section)

The sheet feed section 12 feeds sheets P, which are loaded on a sheet feed tray 30, to the treatment liquid applying section 14 one by one. The sheet feed section 12 as an example of a sheet feeding unit mainly includes a sheet feed tray 30, a sucker device 32, a sheet feed roller pair 34, a feeder board 36, a front stopper 38, and a sheet feed drum 40.

Sheets P are placed on the sheet feed tray 30 in the form of a bundle in which a plurality of sheets are stacked. The sheet feed tray 30 is provided so as to be capable of being moved up and down by a sheet feed tray lift (not shown). Since the driving of the sheet feed tray lift is controlled while interlocking with an increase/decrease in the number of sheets P loaded on the sheet feed tray 30, the sheet feed tray lift moves the sheet feed tray 30 up and down so that the uppermost sheet P of the bundle is always positioned at a constant height.

The sheet P as a recording medium is not particularly limited, but general-purpose printing sheets (sheets using cellulose as a main component, such as so-called high-quality paper, coated paper, and art paper) can be used. Coated paper is used in this embodiment. Coated paper is generally a sheet that includes a coating layer formed by applying a coating material to the surface of high-quality paper, neutral paper, or the like not subjected to surface treatment. Specifically, art paper, coated paper, lightweight coated paper, fine coated paper, and the like are suitably used.

The sheets P loaded on the sheet feed tray 30 are lifted from the top one by one by the sucker device 32 and are fed to the sheet feed roller pair 34. The sheet P, which is fed to the sheet feed roller pair 34, is sent forward by a pair of upper and lower rollers 34A and 34B forming the sheet feed roller pair 34, and is placed on the feeder board 36. The sheet P, which is placed on the feeder board 36, is conveyed by a tape feeder 36A that is provided on the conveying surface of the feeder board 36. Further, while being conveyed, the sheet P is pressed against the conveying surface of the feeder board 36 by a retainer 36B. Accordingly, the irregularity of the sheet is corrected. When an end of the sheet P conveyed by the feeder board 36 comes into contact with the front stopper 38, the inclination of the sheet P is corrected. After that, the sheet P is delivered to the sheet feed drum 40. Then, the sheet P is conveyed to the treatment liquid applying section 14 by the sheet feed drum 40.

(Treatment Liquid Applying Section)

The treatment liquid applying section 14 applies predetermined treatment liquid to the surface (drawing surface) of the sheet P. The treatment liquid applying section 14 mainly includes a treatment liquid applying drum 42 that conveys the sheet P, and a treatment liquid applying unit 44 that applies predetermined treatment liquid to the printing surface of the sheet P conveyed by the treatment liquid applying drum 42.

The sheet P, which is delivered from the sheet feed drum 40 of the sheet feed section 12, is received by the treatment liquid applying drum 42. When the treatment liquid applying drum 42 holds an end of the sheet P by a gripper 42A and rotates, the treatment liquid applying drum 42 winds the sheet P on the peripheral surface thereof and conveys the sheet P. While the sheet P is conveyed by the treatment liquid applying drum 42, a coating roller 44A comes into pressure contact with the surface of the sheet P and the treatment liquid is applied to the surface of the sheet P.

Here, treatment liquid having a function to allow a coloring material, which is contained in aqueous UV ink ejected to the sheet P by the image forming section 18 provided on the rear stage, to aggregate is applied as the treatment liquid that is applied to the surface of the sheet P. When aqueous UV ink is ejected to the sheet P after the above-mentioned treatment liquid is applied to the surface of the sheet P, it is possible to perform high-quality printing without causing impact interference and the like even in a case in which a general-purpose printing sheet is used.

(Treatment Liquid Drying Processing Section)

The treatment liquid drying processing section 16 performs processing for drying the sheet P where the treatment liquid is applied to the surface. The treatment liquid drying processing section 16 mainly includes a treatment liquid drying processing drum 46 that conveys the sheet P, a sheet conveying guide 48, and a treatment liquid drying processing unit 50 that dries the sheet P by blowing hot air to the printing surface of the sheet P conveyed by the treatment liquid drying processing drum 46.

The sheet P, which is delivered from the treatment liquid applying drum 42 of the treatment liquid applying section 14, is received by the treatment liquid drying processing drum 46. When the treatment liquid drying processing drum 46 holds an end of the sheet P by a gripper 46A and rotates, the treatment liquid drying processing drum 46 conveys the sheet P. The treatment liquid drying processing drum 46 conveys the sheet P while the surface (the surface to which the treatment liquid is applied) of the sheet P faces the inside. While the sheet P is conveyed by the treatment liquid drying processing drum 46, hot air is blown to the surface of the sheet P from the treatment liquid drying processing units 50 that are installed in the treatment liquid drying processing drum 46. Accordingly, the sheet P is subjected to drying processing. That is, a solvent component contained in the treatment liquid is removed. Therefore, an ink aggregation layer is formed on the surface of the sheet P.

(Image Forming Section)

The image forming section 18, which is a drawing unit that records an image, draws a color image on the printing surface of the sheet P by ejecting droplets of ink (aqueous UV ink) having colors of C (cyan), M (magenta), Y (yellow), and K (black) to the printing surface of the sheet P. The image forming section 18 mainly includes: an image recording drum 52 that conveys the sheet P; a sheet pressing roller 54 that presses the sheet P conveyed by the image recording drum 52 to allow the sheet P to come into close contact with the peripheral surface of the image recording drum 52; inkjet heads 56C, 56M, 56Y, and 56K as examples of discharge heads that discharge ink droplets having the respective colors of C, M, Y, and K to the sheet P; an in-line sensor 58 that reads an image recorded on the sheet P; a mist filter 60 that catches ink mist; and a drum cooling unit 62.

The image recording drum 52 receives the sheet P from the treatment liquid drying processing drum 46 of the treatment liquid drying processing section 16, and conveys the sheet P to the heating-drying processing section 20. The image recording drum 52 is formed in a cylindrical shape, and is driven by a motor so as to rotate. Grippers 52A are provided on the outer peripheral surface of the image recording drum 52, and an end of the sheet P is gripped by the gripper 52A. When the image recording drum 52 grips an end of the sheet P by the gripper 52A and rotates, the image recording drum 52 conveys the sheet P to the heating-drying processing section 20 while winding the sheet P on the peripheral surface thereof. Further, the image recording drum 52 includes a plurality of suction holes (not shown) that are formed on the peripheral surface thereof in a predetermined pattern. Since the sheet P, which is wound on the peripheral surface of the image recording drum 52, is sucked from the suction holes, the sheet P is conveyed while being held on the peripheral surface of the image recording drum 52 by suction. Accordingly, the sheet P can be conveyed with high smoothness.

The sheet P, which is delivered from the treatment liquid drying processing drum 46 of the treatment liquid drying processing section 16, is received by the image recording drum 52. When the image recording drum 52 grips an end of the sheet P by the gripper 52A and rotates, the image recording drum 52 conveys the sheet P. The sheet P, which is delivered to the image recording drum 52, is made to come into close contact with the peripheral surface of the image recording drum 52 by passing through the sheet pressing roller 54 first. Simultaneously, air is sucked from the suction holes of the image recording drum 52 and the sheet P is held on the outer peripheral surface of the image recording drum 52 by suction. The sheet P is conveyed in this state, and passes by the respective inkjet heads 56C, 56M, 56Y, and 56K. Further, when the sheet P passes by the respective inkjet heads 56C, 56M, 56Y, and 56K, droplets of ink having the respective colors of C, M, Y, and K are ejected to the surface of the sheet P from the respective inkjet heads 56C, 56M, 56Y, and 56K according to the contents of an image. Accordingly, a color image is drawn on the surface of the sheet P. Since the ink aggregation layer is formed on the surface of the sheet P, it is possible to record a high-quality image without causing image defects, such as feathering and bleeding. After processing for drawing an image is performed and suction is released, the sheet P is delivered to the heating-drying processing section 20 through a delivery section 19 to be described below.

(Delivery Section)

The delivery section 19 receives the sheet P, on which an image has been recorded, from the image forming section 18 and has a function to deliver the sheet P to the heating-drying processing section 20. The delivery section 19 mainly includes a chain gripper 64 as an example of a conveying unit that conveys the sheet P on which an image is formed, and a back tension applying mechanism 66 that applies back tension (tension) to the sheet P conveyed by the chain gripper 64.

The chain gripper 64 is a sheet conveying mechanism that is used in common to the delivery section 19, the heating-drying processing section 20, the UV irradiation processing section 22, and the sheet discharge section 24. The chain gripper 64 receives the sheet P delivered from the image forming section 18 and conveys the sheet P up to the sheet discharge section 24.

When a motor (not shown) connected to a first sprocket 64A is driven, a chain 64C travels. The chain 64C travels at the same speed as the peripheral speed of the image recording drum 52. Further, timing is adjusted so that the sheet P, which is delivered from the image recording drum 52, is received by each gripper 78.

The back tension applying mechanism 66 applies back tension (tension) to the sheet P that is conveyed while an end of the sheet P is gripped by the chain gripper 64. The back tension applying mechanism 66 mainly includes a delivery guide plate 71 as a conveying surface that is installed on a delivering/conveying path 69, a first guide plate 72 (suction board) as a conveying surface that is disposed in the heating-drying processing section 20, and a second guide plate 82 that is disposed in the UV irradiation processing section 22.

The delivery guide plate 71 is provided along the chain 64C that travels along the delivering/conveying path 69, the first guide plate 72 is provided along the chain 64C that travels along a first horizontal conveying path 70A, and the second guide plate 82 is provided along the chain 64C that travels along a second horizontal conveying path 70B. Accordingly, while the sheet P is conveyed along the delivering/conveying path 69, the first horizontal conveying path 70A, and the second horizontal conveying path 70B, back tension is applied to the sheet P.

As shown in FIG. 1, the first guide plate 72 is provided along the conveying path of the sheet P that is conveyed by the chain gripper 64 (the travel path of the chain), and serves as the conveying surface for the sheet P. Specifically, the first guide plate 72 is provided along the chain 64C that travels along the first horizontal conveying path 70A, and is provided so as to be away from the chain 64C by a predetermined distance. Further, the second guide plate 82 is also provided along the chain 64C that travels along the second horizontal conveying path 70B, and is provided so as to be away from the chain 64C by a predetermined distance. The lower surface of the sheet P, which is conveyed on the outer peripheral side of the chain 64C by the chain gripper 64, is sucked into an upper surface 72A of the first guide plate 72 and an upper surface 82A of the second guide plate 82, and the sheet P is conveyed while being dragged.

As shown in FIG. 2, a sensor 101, which is a detection unit that detects ambient temperature, is provided near the delivering/conveying path 69 on the delivery guide plate 71, that is, between the image forming section 18 and the heating-drying processing section 20. As long as being capable of detecting the temperature of air, the sensor 101 is not limited to a specific kind of sensor. As long as withstanding heat generated from the heating-drying processing section 20, various temperature measuring units, such as a thermocouple, a thermistor, and a resistance temperature detector, can be used as the sensor 101.

In-device ambient temperature, which is detected by the sensor 101, is sent to the control unit 90 as shown in FIG. 2, and the control unit 90 determines whether or not a standby mode and a recording mode of the inkjet recording device 10 have been switched or a recording operation is started according to an operation sequence to be described below on the basis of data of the ambient temperature.

It is preferable that the installation position of the sensor 101 is in a continuous space that does not include a clear partition between itself and a space to which the sheet P is conveyed. Moreover, it is preferable that the sensor 101 is installed at a position close to the surface of the sheet P in a range that does not interfere with other members or the conveying path, and it is preferable that the sensor 101 is installed in a space in which a shield is not present on a straight line connecting one arbitrary point on the surface of the sheet P to the sensor 101. Where the above-mentioned condition is satisfied, it is possible to more accurately detect the ambient temperature of a space through which the surface of the sheet P passes.

As shown in FIG. 2, an air intake fan 108A, which is an air intake unit that takes in air outside the device, is provided between the image forming section 18 and the heating-drying processing section 20. The air intake fan 108A may be an ordinary axial-flow fan, a centrifugal fan, or other fans. The air intake fan 108A may be provided on a side wall of the inkjet recording device 10 that is close to a position between the image forming section 18 and the heating-drying processing section 20. However, as shown in FIG. 2, an air duct 109A may be provided to extend to a position between the image forming section 18 and the heating-drying processing section 20 from the air intake fan 108A so that air is sent as shown by an arrow 103.

(Heating-Drying Processing Section)

As shown in FIG. 1, the heating-drying processing section 20, which is a drying unit drys ink droplets, performs processing for drying the sheet P, on which an image has been recorded, and removes a liquid component remaining on the surface of the sheet P. The heating-drying processing section 20 mainly includes: the chain gripper 64 as an example of a conveying unit for conveying the sheet P on which an image is formed; the back tension applying mechanism 66 that applies back tension (tension) to the sheet P conveyed by the chain gripper 64; infrared heaters 68 as an example of a light irradiation unit that heats and dries the sheet P, which is conveyed by the chain gripper 64, by irradiating the sheet P with light; and drying air nozzles 118 that send drying air to the lower side (to the sheet P that is conveyed).

Each of the infrared heaters 68 is installed on the inner peripheral side of the chain 64C (above the chain 64C in the drawings), and includes a light source (not shown) and a reflecting plate that is disposed above the light source so as to surround an upper half of the light source. In this embodiment, a lamp, which includes a filament in a quartz tube, has been used as an example of the light source. However, the light source is not limited to a quartz tube and the structure of the light source is not particularly limited as long as the light source can emit infrared rays.

Since a dryer cover 21, which covers the infrared heaters 68 and the drying air nozzles 118 in the device, is provided as shown in FIG. 2, an influence of heat radiated from the infrared heaters 68 and an influence of convected heat are prevented in the device. The dryer cover 21 is formed substantially in the shape of, for example, a box, and is adapted to maintain a gap between itself and the first horizontal conveying path 70A while covering the upper portions of the infrared heaters 68 and the drying air nozzles 118 in the device without interfering with the conveying surface of the sheet P (the first horizontal conveying path 70A). As long as the dryer cover 21 has heat resistance so as to withstand the heat of the infrared heaters 68 and the drying air nozzles 118, the material of the dryer cover 21 is not particularly limited. Metal, such as SUS (Steel Use Stainless), can be suitably used as the material of the dryer cover 21.

The sheet P, which is delivered from the image recording drum 52 of the image forming section 18, is received by the chain gripper 64. The chain gripper 64 conveys the sheet P in a state in which the chain gripper 64 holds a front end portion of the sheet P by the gripper 78 and makes a rear end portion of the sheet P be sucked into the planar first guide plate 72. The sheet P delivered to the chain gripper 64 is conveyed along the first horizontal conveying path 70A first. While being conveyed along the first horizontal conveying path 70A, the sheet P is irradiated with infrared rays by the infrared heaters 68 and drying air is sent to the sheet P from the drying air nozzles 118. Accordingly, heating-drying processing section is performed by heat radiated from the infrared heaters 68 and drying air. Processing for drying the sheet P is performed while back tension (tension) is applied to the sheet P by the back tension applying mechanism 66.

Meanwhile, a structure, which heats and dries the sheet P by applying infrared rays to the sheet P from the infrared heaters 68, has been described in this embodiment, but the invention is not limited thereto. The sheet P may be irradiated with light other than infrared rays so as to be heated and dried, and, for example, far-infrared rays, ultraviolet rays (UV), or the like may be used to heat and dry the sheet.

A position at which the above-mentioned sensor 101 is provided and which is included in the heating-drying processing section 20 means the entire inner space of the dryer cover 21 of the heating-drying processing section 20, the dryer cover 21, and the first horizontal conveying path 70A provided directly below the dryer cover 21. More specifically, the position at which the above-mentioned sensor 101 is provided and which is included in the heating-drying processing section 20 also includes heat sources, such as the infrared heaters 68, the drying air nozzles 118, the inner surface of a member, such as a metal sheet forming the dryer cover 21 covering all of the infrared heaters 68 and the drying air nozzles 118, and the outer surface of the member (since being heated due to an influence of the heat sources). Further, the position at which the above-mentioned sensor 101 is provided and which is included in the heating-drying processing section 20 also includes a position directly below the infrared heater 68 and a position directly below an opening portion of the drying air nozzle 118 through which hot air is blown.

Here, a space through which the chain gripper 64 conveying the sheet P and the sheet P pass needs to be formed on the first horizontal conveying path 70A along which the sheet P is conveyed, regardless of whether or not the space has been positioned directly below the infrared heaters 68 or the drying air nozzle 118. For this reason, the sensor 101 cannot be installed on the first horizontal conveying path 70A. Further, since a space through which the sheet P is conveyed as described above needs to be formed around the first horizontal conveying path 70A at an inlet and an outlet of the heating-drying processing section 20, a partition between the inside and the outside of the heating-drying processing section 20 is not clearly present. However, it is not preferable that the sensor 101 is installed at a position to which air having the heat of the heating-drying processing section 20 is blown.

(UV Irradiation Processing Section)

The UV irradiation processing section 22, which is a fixing unit that performs processing fixing an image, fixes an image, which is formed using UV ink, by irradiating the sheet P, to which aqueous UV ink has been discharged, with ultraviolet rays. As shown in FIG. 1, the UV irradiation processing section 22 mainly includes the chain gripper 64 that conveys the sheet P, the back tension applying mechanism 66 that applies back tension to the sheet P conveyed by the chain gripper 64, and a UV irradiation unit 74 as an example of a UV irradiation unit that irradiates the sheet P, which is conveyed by the chain gripper 64, with ultraviolet rays.

The UV irradiation unit 74 is installed on the inner peripheral side of the chain 64C on the downstream side of the heating-drying processing section 20 in a sheet conveying direction, and irradiates the surface of the sheet P, which is conveyed along the second horizontal conveying path 70B, with ultraviolet rays. Since the UV irradiation unit 74 includes a UV lamp 120 and a UV lamp cover 122 which covers the lateral sides and the upper side of the UV lamp 120 and of which the lower side is open, the UV irradiation unit 74 irradiates the surface of the sheet P, which is conveyed along the second horizontal conveying path 70B, with ultraviolet rays.

A duct 124 is mounted on the UV lamp cover 122. The duct 124 is connected to a suction fan (not shown), and cools the UV lamp 120 by sucking air from a lower opening portion of the UV lamp cover 122.

The sheet P, which has been conveyed to the chain gripper 64 and has been subjected to drying processing by the heating-drying processing section 20, is conveyed to the UV irradiation unit 74. On the second horizontal conveying path 70B, the chain gripper 64 grips an end of the sheet P by the gripper 78 and conveys the sheet P along the second guide plate 82. While the sheet P is conveyed along the second horizontal conveying path 70B, the sheet P is subjected to UV irradiation processing by the UV irradiation unit 74 installed inside the chain gripper 64. That is, the surface of the sheet P is irradiated with ultraviolet rays by the UV irradiation unit 74. While back tension is applied to the sheet P by the back tension applying mechanism 66, the sheet P is subjected to UV irradiation processing. Accordingly, it is possible to perform UV irradiation processing while suppressing the deformation of the sheet P.

The sheet P, which has been conveyed to the chain gripper 64 and has been irradiated with ultraviolet rays by the UV irradiation processing section 22, is conveyed along an inclined conveying path 70C. On the inclined conveying path 70C, the chain gripper 64 grips an end of the sheet P by the gripper 78 and conveys the sheet P along an inclined guide plate 126 that is disposed below the chain 64C along the chain 64C.

As shown in FIG. 1, a sensor 102, which is a detection unit that detects ambient temperature, is provided at the downstream end of the second horizontal conveying path 70B, that is, on the downstream of the UV irradiation processing section 22 in the conveying direction from the second guide plate 82 over the inclined guide plate 126. Similar to the sensor 101, the sensor 102 is not limited to a specific kind of sensor as long as being capable of detecting the temperature of air. As long as withstanding heat generated from the UV irradiation processing section 22, various temperature measuring units, such as a thermocouple, a thermistor, and a resistance temperature detector, can be used as the sensor 102.

In-device ambient temperature, which is detected by the sensor 101, is sent to the control unit 90 shown in FIG. 2, and the control unit 90 determines whether or not a standby mode and a recording mode of the inkjet recording device 10 have been switched or a recording operation has been started according to an operation sequence to be described below on the basis of data of the ambient temperature.

As shown in FIG. 2, an air intake fan 108B, which is an air intake unit that takes in air outside the device, is provided on the downstream side of the UV irradiation processing section 22. The air intake fan 108B may be provided on a side wall of the inkjet recording device 10 that is provided at a position close to the UV irradiation processing section 22. However, as shown in FIG. 2, an air duct 109B may be provided to extend to the downstream side of the UV irradiation processing section 22 from the air intake fan 108B so that air is sent as shown by an arrow 103.

A position at which the above-mentioned sensor 102 is provided and which is included in the UV irradiation processing section 22 includes the entire inner space of the UV lamp cover 122, the UV lamp 120, and the second horizontal conveying path 70B provided directly below the UV lamp 120. Specifically, examples of the position at which the above-mentioned sensor 102 is provided and which is included in the UV irradiation processing section 22 include a filter glass, a filter frame, and the like that are installed directly below an opening portion of the UV lamp 120 in a case in which the UV lamp 120, the UV lamp cover 122, the duct 124, and a UV and heat-resistant filter are provided.

Here, as in the case of the sensor 101, a space through which the chain gripper 64 conveying the sheet P and the sheet P pass needs to be formed on the second horizontal conveying path 70B along which the sheet P is conveyed, regardless of whether or not the space has been positioned directly below the UV irradiation unit 74. For this reason, the sensor 102 cannot be installed on the second horizontal conveying path 70B. Further, around the second horizontal conveying path 70B on the upstream side and the downstream side of the UV irradiation processing section 22, a space through which the sheet P is conveyed as described above needs to be formed and a partition between the inside and the outside of the UV irradiation processing section 22 is not clearly present. However, it is also not preferable that the sensor 102 is installed at a position to which the exhaust air of the duct 124 is blown.

Exhaust fans 106, which are an exhaust unit that for discharges air inside the device to the outside of the inkjet recording device 10, are provided from the heating-drying processing section 20 over the UV irradiation processing section 22 as shown in FIG. 2. The installation positions of the exhaust fans 106 are not particularly limited, but the exhaust fans 106 are preferably provided on the bottom, the back surface, or the like, which corresponds to the UV irradiation processing section 22, of the inkjet recording device 10 from the heating-drying processing section 20. The corresponding bottom and the corresponding back surface mean the back surface and the bottom of the inkjet recording device 10 that are closest to positions at which the above-mentioned sensors 101 and 102 are provided on the first and second horizontal conveying paths 70A and 70B for the sheet P. Here, the exhaust fans 106 are provided at positions, which are closest to the sensors 101 and 102, on a panel or the like that forms the outline of the inkjet recording device 10. However, in a case in which a duct is provided to guide exhaust air as in the air intake fan 108B, the positions of the exhaust fans 106 are not limited thereto and the exhaust fans 106 can be installed at free positions.

The exhaust fan 106 may be an axial-flow fan, a centrifugal fan, or other fans. In regards to positions at which the exhaust fans 106 are provided, a plurality of exhaust fans 106 may be provided from the heating-drying processing section 20 over the UV irradiation processing section 22 so as to uniformly reduce pressure, or more exhaust fans 106 may be provided on one of the heating-drying processing section 20 and the UV irradiation processing section 22 or may be provided on only one of the heating-drying processing section 20 and the UV irradiation processing section 22 in order to chiefly discharge air from the vicinity of any one of the heating-drying processing section 20 and the UV irradiation processing section 22 due to the ease of the rise of ambient temperature.

When heated air, which is present in the vicinity of the heating-drying processing section 20 and the UV irradiation processing section 22, is discharged to the outside of the device as shown by arrows 104 by the exhaust fans 106, pressure in the device is reduced. When air of which the temperature is lower than temperature in the device flows into the device from the outside, ambient temperature in the vicinity of the sensors 101 and 102 is lowered.

(Sheet Discharge Section)

The sheet discharge section 24 recovers the sheet P that has been subjected to a series of processing for recording an image. The sheet discharge section 24 mainly includes the chain gripper 64 that conveys the sheet P irradiated with UV rays, and a sheet discharge tray 76 on which the sheet P is stacked and recovered.

The chain gripper 64 is used in common to the heating-drying processing section 20 and the UV irradiation processing section 22 as described above. The chain gripper 64 releases the sheet P above the sheet discharge tray 76 and stacks the sheet P on the sheet discharge tray 76.

The sheet P released from the chain gripper 64 is stacked and recovered on the sheet discharge tray 76. The sheet discharge tray 76 is provided with sheet stoppers (a front sheet stopper, a rear sheet stopper, a lateral sheet stopper, and the like) (not shown) so that sheet P is stacked in an orderly manner. Moreover, a cooling unit, such as a cooling fan, may be provided on the sheet discharge tray 76 or on the upstream side of the sheet discharge tray 76 in the conveying direction to cool the sheet P to be recovered. As temperature rises, the sheet P is likely to be damaged as described above. Since printed surfaces are likely to adhere to each other during duplex printing, it is preferable that the sheet P having been subjected to processing is cooled.

Further, the sheet discharge tray 76 is provided so as to be capable of being moved up and down by a sheet discharge tray ascending and descending device (not shown). Since the driving of the sheet discharge tray ascending and descending device is controlled while interlocking with an increase/decrease in the number of sheets P stacked on the sheet discharge tray 76, the sheet discharge tray ascending and descending device moves the sheet discharge tray 76 up and down so that the uppermost sheet P is always positioned at a constant height.

(Operation Sequence)

Next, an operation sequence of the inkjet recording device 10 of this embodiment will be described in detail.

Figure 3:
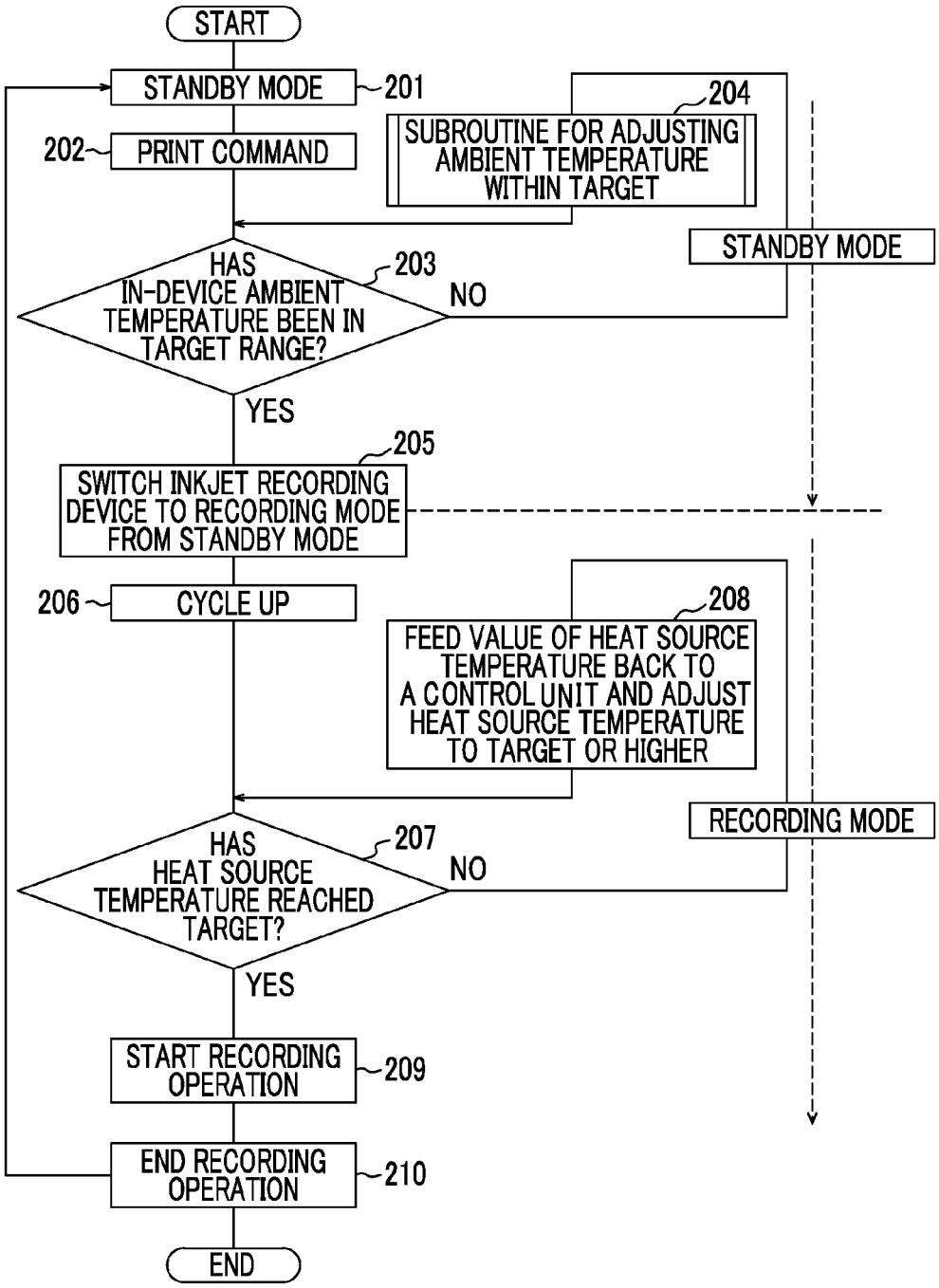
FIG. 3 is a flowchart illustrating an operation sequence of the inkjet recording device according to the first embodiment of the invention.

FIG. 3 is a flowchart illustrating an operation sequence of the recording operation of the inkjet recording device 10.

In Step 201, a standby mode in a standby state is made when power is supplied to the inkjet recording device 10. In Step 202, a print command is transmitted to the control unit 90 through an operation unit (not shown) by an operator. Then, a procedure proceeds to Step 203.

It is determined in Step 203 whether or not the ambient temperature detected by the sensor 101 provided in the device has been in a target range. Here, the sensor 102 may be used instead of the sensor 101. Alternatively, temperatures detected by both the sensors 101 and 102 may be used. In a case in which the temperatures detected by both the sensors 101 and 102 are used, it is determined whether or not the temperatures detected by both the sensors 101 and 102 have been in the target range.

The target range of the ambient temperature, which is mentioned here, is preferably a range of 25 to 40° C. and more preferably a range of 30 to 35° C. at a position between the image forming section 18 and the heating-drying processing section 22 in which the sensor 101 is provided. That is, from experiments, the inventors acquire knowledge that excellent quality is obtained when ambient temperature at the installation position of the sensor 101 is in the above-mentioned range. Specifically, if the ambient temperature is lower than 25° C., there is a concern that the drying properties of the sheet P may change. Further, if the ambient temperature exceeds 40° C., the temperature of the image forming section 18 is too high. For this reason, there are concerns that dew condensation may occur on a head surface due to a difference between the temperature of ink contained in the inkjet head 56 and the ambient temperature and discharge properties may be affected.

Moreover, the target range of the ambient temperature is also preferably a range of 25 to 40° C. and more preferably a range of 30 to 35° C. on the downstream of the UV irradiation processing section 22 in the conveying direction where the sensor 102 is provided. That is, from experiments, the inventors acquire knowledge that excellent quality is obtained when ambient temperature at the installation position of the sensor 102 is in the above-mentioned range. Specifically, if the ambient temperature is lower than 25° C., there is a concern that the drying properties of the sheet P may change. Further, if the ambient temperature exceeds 40° C., the temperature of the sheet P in the sheet discharge section 24 is too high. For this reason, there is a concern that stacked sheets P may cause blocking.

In a case in which the ambient temperature detected by the sensor 101 (or the sensor 102 or both the sensors 101 and 102) is not in the target range in Step 203, the procedure proceeds to a subroutine 204 (a subroutine for adjusting the ambient temperature within the target range). In the subroutine 204, the value of the detected in-device ambient temperature is fed back to the control unit 90 so as to be in the target range. Examples of a method of making the ambient temperature be in the target range include the following method.

Figure 4:
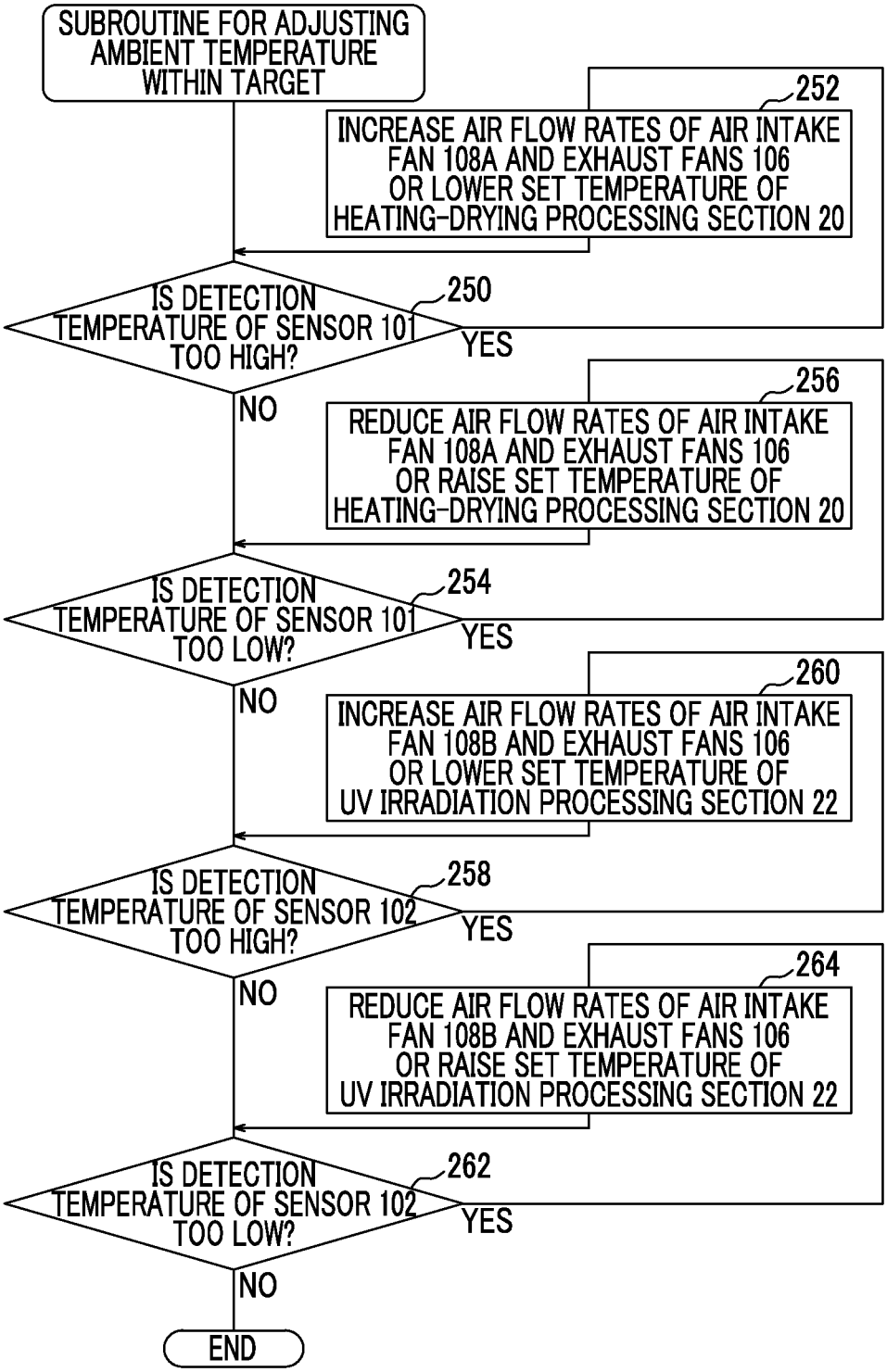
FIG. 4 is a flowchart illustrating the detail of a subroutine that is a part of the operation sequence shown in FIG. 3.

As shown in FIG. 4, it is determined in Step 250 whether or not the ambient temperature detected by the sensor 101 is too higher than the target range. In a case in which the ambient temperature detected by the sensor 101 is higher than the target range, the procedure proceeds to Step 252 and the air intake fan 108A and the exhaust fans 106 shown in FIG. 2 are started up (the air flow rates of the air intake fan 108A and the exhaust fans 106 are increased in a case in which the air intake fan 108A and the exhaust fans 106 are already started up) or the intensity of heating of the heating-drying processing section 20 as a heat source is reduced so that the ambient temperature is made to be in the target range. Other a heat dissipating unit such as heat pipes may be provided and used together.

If it is determined that the ambient temperature detected by the sensor 101 is not too high, the procedure proceeds to Step 254 and it is determined whether or not the ambient temperature is too low. In a case in which the ambient temperature detected by the sensor 101 is too lower than the target range, a method of raising the ambient temperature by increasing the intensity of heating (set temperature) of the heating-drying processing section 20 as a heat source may be used. Further, in a case in which the exhaust fans 106 and the air intake fan 108A are already started up, a method of reducing the air flow rates of the air intake fan 108A and the exhaust fans 106, a method of stopping the exhaust fans 106 and the air intake fan 108A, or the like can be used. Alternatively, a heater for adjusting the ambient temperature may be separately provided to heat air, or a plurality of methods among the above-mentioned methods may be used together.

If it is determined in Step 254 that the ambient temperature detected by the sensor 101 is not too low, it is determined in Step 258 whether the ambient temperature detected by the sensor 102 is too higher than the target range. In a case in which the ambient temperature detected by the sensor 102 is higher than the target range, the procedure proceeds to Step 260 and the air intake fan 108B and the exhaust fans 106 shown in FIG. 2 are started up (in a case in which the air intake fan 108B and the exhaust fans 106 are already started up, the air flow rates of the air intake fan 108B and the exhaust fans 106 are increased) or the set intensity the UV irradiation processing section 22 as a heat source is reduced to lower the ambient temperature so that the ambient temperature is made to be in the target range. Other a heat dissipating unit such as heat pipes may be provided and used together as in the case of the sensor 101. Meanwhile, the set intensity of the UV irradiation processing section 22, which is mentioned here, means any one of the output (W/cm), the light intensity (J/cm2), and the illuminance (W/cm2) of the UV lamp 120, or means several thereof.

If it is determined that the ambient temperature detected by the sensor 102 is not too high, the procedure proceeds to Step 262 and it is determined whether or not the ambient temperature is too low. In a case in which the ambient temperature detected by the sensor 102 is too lower than the target range, a method of raising the ambient temperature by increasing the set intensity of the UV irradiation processing section 22 as a heat source may be used. Further, in a case in which the exhaust fans 106 and the air intake fan 108B are already started up, a method of reducing the air flow rates of the air intake fan 108A and the exhaust fans 106, a method of stopping the exhaust fans 106 and the air intake fan 108A, or the like can be used. Alternatively, a heater for adjusting the ambient temperature may be separately provided to heat air, or a plurality of methods among the above-mentioned methods may be used together.

Step 203 and the subroutine 204 are repeated, and the procedure proceeds to Step 205 if the ambient temperature is made to be in the target range. In Step 205, the entire inkjet recording device 10 is switched to the recording mode from the standby mode. Accordingly, the switching (cycle-up) of the inkjet recording device to the recording mode to be described below is started in Step 206. Specifically, the heat source temperature of the heating-drying processing section 20 and the intensity of heating (set intensity) of the UV irradiation processing section 22 are set to a target value (standby temperature), which corresponds to the time of standby, in the standby mode; and the heat source temperature of the heating-drying processing section 20 and the output intensity of the UV irradiation processing section 22 are switched to actual temperatures, which are target values corresponding to the time of recording, in the recording mode, so that the inkjet recording device 10 is in a state in which the recording operation can be performed.

Next, it is determined in Step 207 whether or not the temperatures of the heat sources (the heating-drying processing section 20 and the UV irradiation processing section 22) have reached targets. If the temperatures of the heat sources are lower than target temperatures, the procedure proceeds to Step 208 and the values of the temperatures of the heat sources are fed back to the control unit 90. Step 208 is repeated until the control unit 90 determines that the heat sources reach the target temperatures.

If the temperatures of the heat sources reach the target temperatures, the procedure proceeds to Step 209 and the inkjet recording device 10 can start the recording operation. The recording operation is performed from this state by an operator's operation, and the recording operation is ended after the above-mentioned process.

Figure 7:
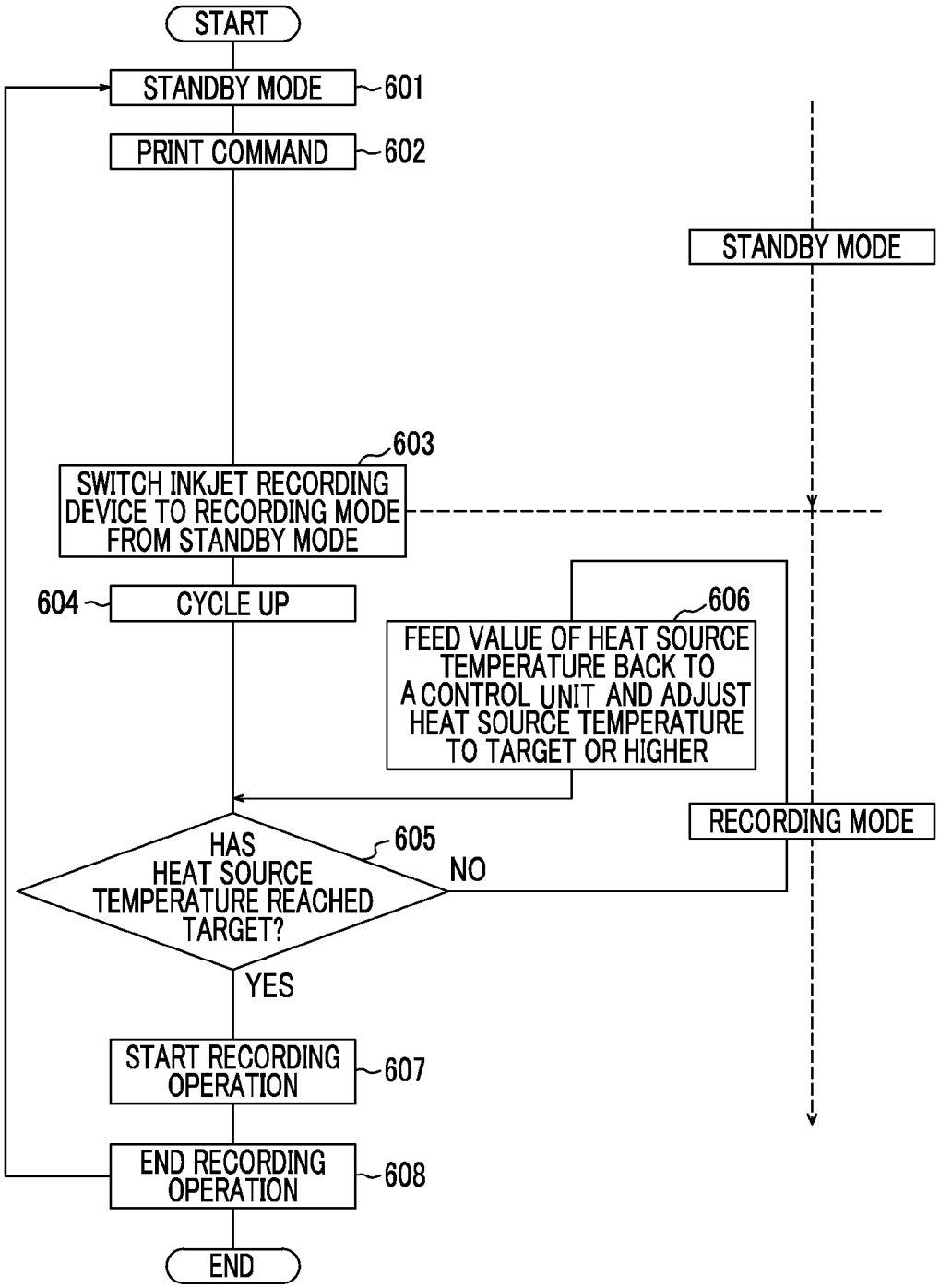
FIG. 7 is a flowchart illustrating the operation sequence of the inkjet recording device of the comparative example.

The above-mentioned operation sequence will be compared with a comparative example shown in FIG. 7, that is, an operation sequence that does not employ this embodiment. In the comparative example, a print command is received in Step 602, a procedure directly proceeds to Step 603, and the inkjet recording device is switched to a recording mode. Accordingly, cycle-up is started in Step 604 regardless of in-device ambient temperature, and a recording operation is started in Step 607 if the temperature of the heat source reaches a target temperature.

For this reason, since in-device ambient temperature measured at a position, which is relative distant from a heat source, such as the heating-drying processing section 20 or the UV irradiation processing section 22, is not under the control of a control unit, detection and control are not performed and the in-device ambient temperature is not constant. For example, as shown in FIG. 2, the installation position of the sensor 101 (between the image forming section 18 and the heating-drying processing section 20) and the installation position of the sensor 102 (between the UV irradiation processing section 22 and the sheet discharge section 24) are likely to be affected by the operation states of the device (for example, a state in which air in the device is still cool immediately after the start of the device, a state in which the device is operated for a long time and air in the device is heated, and the like), seasonal changes of temperature (for example, room temperature is low in winter, room temperature is high in summer, and the like).

Particularly, the installation position of the sensor 101 is present in an area in front of drying immediately after drawing using ink on the sheet P, and the ambient temperature at this portion is likely to affect the initial drying properties of the sheet P to which ink has been applied. Further, the installation position of the sensor 102 is present in an area through which the sheet P passes at high temperature after the completion of the processing performed by the UV irradiation processing section 22, and the ambient temperature at this portion affects time while the sheet P maintains high temperature (the degree of cooling) and affects drying properties.

A structure in which both the sensors 101 and 102 are provided and the ambient temperature is controlled is most preferable in order to maintain constant drying properties of the sheet P. However, only one of the sensors 101 and 102 may be provided according to the change range and the change rate of the in-device ambient temperature and the ambient temperature may be controlled by the sensor.

(Functional Effects)

Next, the functions and effects of the inkjet recording device 10 according to this embodiment will be described.

Since in-device ambient temperature (more specifically, ambient temperatures at the installation positions of the sensors 101 and 102) is made to be in a target range and a recording operation is started in the operation sequence according to this embodiment, it is possible to prevent the drying properties of the sheet P from changing. That is, when the ambient temperature at the installation position of the sensor 101 is maintained constant, it is possible to prevent dew condensation that occurs on a head surface due to a difference between the temperature of ink contained in the inkjet head 56 and the temperature of the image forming section 18 that is caused by the excessive temperature rise of the image forming section 18. Meanwhile, when the ambient temperature at the installation position of the sensor 102 is maintained constant, it is possible to prevent the temperature of the sheet P from excessively rising in the sheet discharge section 24. Accordingly, it is possible to prevent the blocking of the stacked sheets P.

Second Embodiment

Figure 5A:
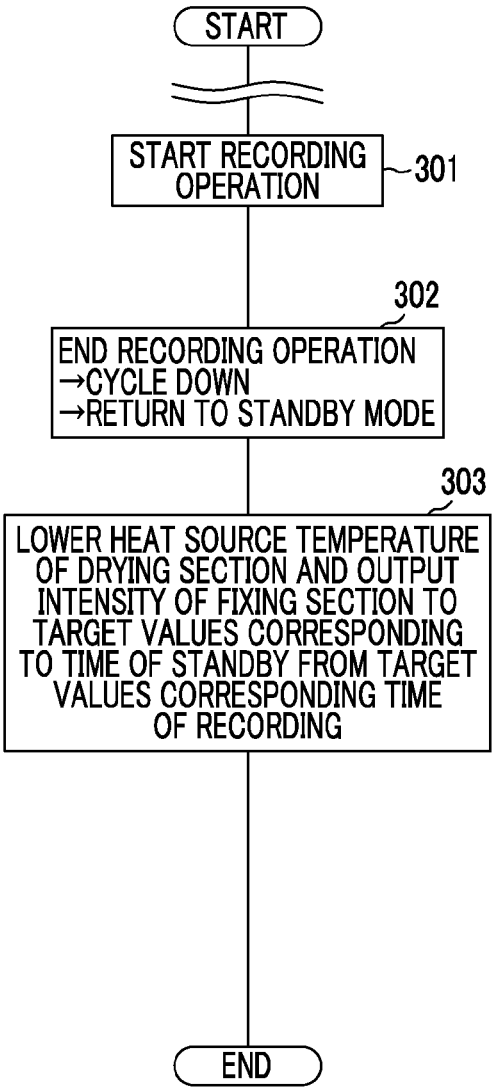
FIG. 5A is a flowchart illustrating a part of an operation sequence of the inkjet recording device of a comparative example.
Figure 5B:
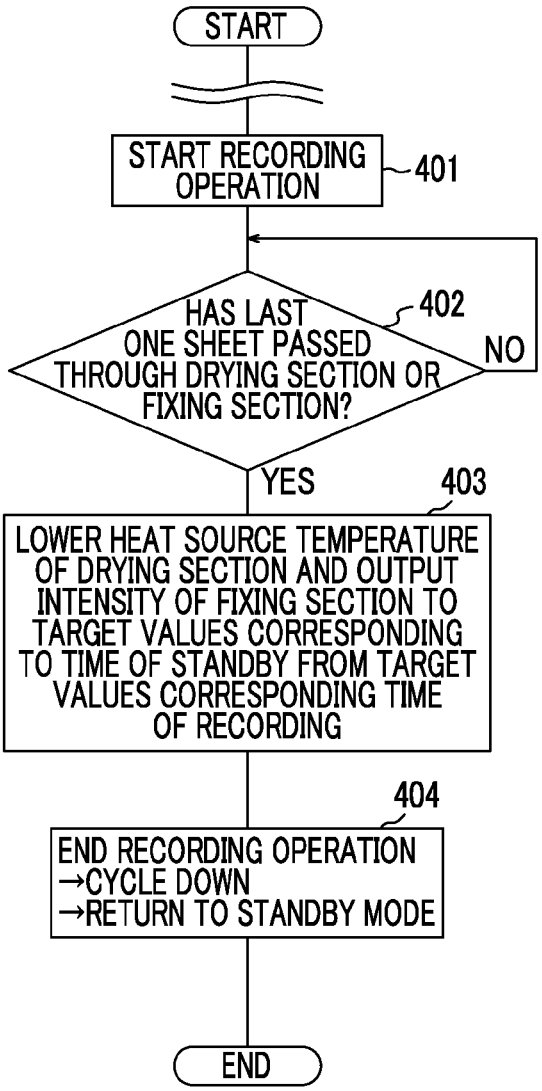
FIG. 5B is a flowchart illustrating a part of an operation sequence of the inkjet recording device according to a second embodiment of the invention.

FIG. 5A is a flowchart illustrating a part of an operation sequence of a recording operation of the inkjet recording device of a comparative example that does not employ this embodiment, and FIG. 5B is a flowchart illustrating a part of an operation sequence of a recording operation of the inkjet recording device 10 according to a second embodiment of the invention. Steps, which are performed before the recording operation is started, will be omitted here.

In Step 401 shown in FIG. 5B, the switching (cycle-up) of the inkjet recording device to the recording mode is ended and the recording operation of the inkjet recording device 10 is performed. An operator ends an operation and the procedure proceeds to Step 402. It is determined in Step 402 where or not the last one sheet P, which is currently being subjected to processing, has passed through the heating-drying processing section 20 or the UV irradiation processing section 22.

When the sheet P has passed, the procedure proceeds to Step 403. That is, the set temperature (output intensity) of the heating-drying processing section 20 or the UV irradiation processing section 22 is lowered to a target value, which corresponds to the time of standby, from a target value that corresponds to the time of recording. Accordingly, since heat, which is generated from the heating-drying processing section 20 or the UV irradiation processing section 22, is reduced (even though the last sheet P is being subjected to processing), the amount of heat radiated into the device is also reduced. Next, the procedure proceeds to Step 404, and the entire device is cycled down and returns to the standby mode when the recording operation is ended.

In this sequence, between the start of a recording operation of Step 301 and the end of the recording operation of Step 302 in a sequence of the comparative example shown in FIG. 5A, the temperature of a heat source (the heating-drying processing section 20 or the UV irradiation processing section 22) continues to be maintained in a recording mode until a sheet P is completely discharged to the sheet discharge section 24. The sequences shown in FIGS. 5A and 5B are different from each other in that the temperature or the output intensity of the heat source is lowered to a target value, which corresponds to the time of standby, from a target value, which corresponds to the time of recording, even during processing when the last one sheet P has passed through the heat source.

That is, in the operation sequence shown in FIG. 5A, a time lag slightly occurs until a printing operation is actually ended (for example, until the sheet P reaches the sheet discharge section 24) after a sheet P passes by a position directly below the heat source. Since the heat of the heat source remains in the device without being applied to the sheet P during the time lag, ambient temperature is likely to rise.

In contrast, in the operation sequence according to this embodiment shown in FIG. 5B, when a target value of the heat source temperature of the heating-drying processing section 20 and a target value of the output intensity of the UV irradiation processing section 22 are returned to settings, which corresponds to the time of standby, from settings, which correspond to the time of recording, immediately after the last one sheet P passes by the heat source (the heating-drying processing section 20 or the UV irradiation processing section 22) before the recording operation is completely ended, it is possible to prevent extra heat (which is not transferred to the sheet P) from remaining in the device.

Third Embodiment

Figure 6:
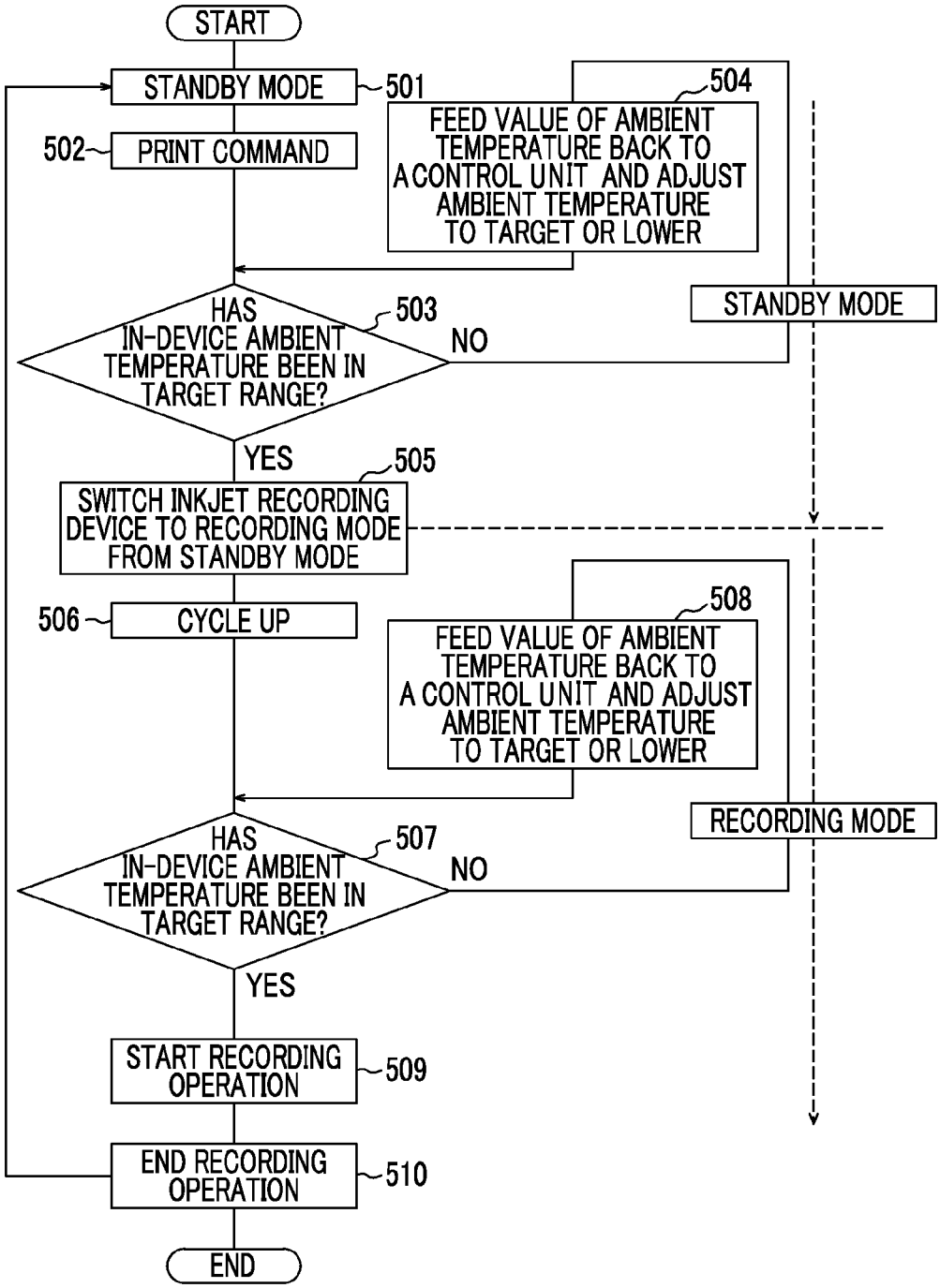
FIG. 6 is a flowchart illustrating an operation sequence of the inkjet recording device according to a third embodiment of the invention.

FIG. 6 is a flowchart illustrating an operation sequence of a recording operation of the inkjet recording device 10 according to a third embodiment of the invention. The same processing as the subroutine 204 shown in FIG. 4 is performed in Step 504. Meanwhile, since Step 501 to Step 506 (cycle-up) are the same as the first embodiment, Step 501 to Step 506 will be omitted.

Cycle-up is performed in Step 506 shown in FIG. 6; and the heat source temperature of the heating-drying processing section 20 and the output intensity (temperature settings) of the UV irradiation processing section 22 are switched to actual temperatures, which are target values corresponding to the time of recording, from target values (standby temperatures) corresponding to the time of standby, so that the inkjet recording device 10 is in a state in which the recording operation can be performed.

Next, the procedure proceeds to Step 507 and it is determined whether or not the ambient temperature detected by the sensor 101 (or the sensor 102 or both the sensors 101 and 102) has been in a target range. In a case in which the ambient temperature is not in the target range, the procedure proceeds to Step 508 and the value of the ambient temperature is fed back to the control unit 90 so as to be in the target range. Various methods are considered as a method of making the ambient temperature be in the target range as described above. Meanwhile, since a control method is the same as the subroutine 204 shown in FIG. 4, the control method will be omitted.

If it is determined that the ambient temperature is in the target range, procedure proceeds to Step 509 and the recording operation is started. Steps after the Step 509 are the same as the first embodiment.

The effects of the operation sequence according to this embodiment are as follows: that is, when the inkjet recording device 10 is switched to a recording mode from a standby mode, the heat source temperature of the heating-drying processing section 20 and the output intensity of the UV irradiation processing section 22 are increased to target values corresponding to the time of recording from target values corresponding to the time of standby by a cycle-up operation. However, the amount of heat to be emitted from the heat source is naturally increased in that case.

For this reason, a case in which the in-device ambient temperature exceeds an upper limit of the target range due to a cycle-up operation when the inkjet recording device is completely switched to a recording mode even though the in-device ambient temperature at the time of a standby mode is in the target range, that is, a so-called overshoot case is considered.

In the operation sequence according to this embodiment, the in-device ambient temperature is detected by the sensor 101 (or the sensor 102 or both the sensors 101 and 102) even during the cycle-up operation, and the control unit 90 controls the inkjet recording device so that the recording operation is not started before the ambient temperature is made to be in the target range. For this reason, since the sheet P is subjected to recording under the ambient temperature that is in the target range, it is possible to prevent the drying properties of the sheet P from changing.

Other Modification Examples

The first to third embodiments of the invention have been described above, but the invention is not limited to the above-mentioned embodiments at all. It goes without saying that the invention may have various aspects without departing from the scope of the invention.

For example, a recording operation may be performed according to a sequence that has the contents in which the sequences of the respective embodiments are incorporated. A heater for ambient temperature (not shown) is provided at an arbitrary position in the vicinity of the sensors 101 and 102 in the device or on the air intake fan 108, and may be turned on to raise the ambient temperature and may be turned off to lower the ambient temperature. When ambient temperature is controlled by a temperature rise using a heater, the ambient temperature can be controlled without the heat generated from the heating-drying processing section 20 and the UV irradiation processing section 22. Accordingly, there is no concern that the heating-drying processing section 20 and the UV irradiation processing section 22 are heated even when it is difficult to raise ambient temperature as in winter or the like.

Alternatively, the installation position of the sensor is not limited to a position between the image forming section 18 and the heating-drying processing section 20 and a position on the downstream side of the UV irradiation processing section 22, and a sensor for detecting ambient temperature may be provided at other position except for these positions and control the ambient temperature so that constant drying properties of the sheet P are maintained. For example, ambient temperature may be detected and controlled on the upstream side of the image forming section 18, or the ambient temperature of the sheet discharge section 24 may be detected and controlled.

EXPLANATION OF REFERENCES

10: inkjet recording device
18: image forming section (drawing unit)
20: heating-drying processing section (drying unit)
22: UV irradiation processing section (fixing unit)
90: control unit
101: sensor (detection unit)
102: sensor (detection unit)
106: exhaust fan (exhaust unit)
108A: air intake fan (air intake unit)
108B: air intake fan (air intake unit)

What is claimed is:

1. An inkjet recording device comprising:
a drawing unit that records an image by applying ink droplets to a recording medium;
a drying unit that is provided on a downstream side of the drawing unit in a conveying direction and dries the ink droplets applied to the recording medium;
a detection unit that is provided on a downstream side of the drawing unit in the conveying direction and detects an ambient temperature outside the drying unit in the device; and
a control unit that controls the ambient temperature outside the drying unit in the device and switches the inkjet recording device to a recording mode in which set temperature of the drying unit is used as a target value corresponding to time of recording from a standby mode in which set temperature of the drying unit is used as a target value corresponding to time of standby in the case where the ambient temperature reaches a target range.

2. The inkjet recording device according to claim 1,
wherein the detection unit is provided between the drawing unit and the drying unit.

3. The inkjet recording device according to claim 2,
wherein the detection unit is provided on a downstream side of the drying unit in a conveying direction.

4. The inkjet recording device according to claim 3,
wherein the ambient temperature is detected even during a temperature raising operation performed after the inkjet recording device is switched to the recording mode, and
a recording operation is started after the ambient temperature enters a target range.

5. The inkjet recording device according to claim 3, further comprising:
a heater for raising the ambient temperature in the recording device.

6. The inkjet recording device according to claim 2,
wherein the ambient temperature is detected even during a temperature raising operation performed after the inkjet recording device is switched to the recording mode, and
a recording operation is started after the ambient temperature enters a target range.

7. The inkjet recording device according to claim 6, further comprising:
a heater for raising the ambient temperature in the recording device.

8. The inkjet recording device according to claim 2, further comprising:
a heater for raising the ambient temperature in the recording device.

9. The inkjet recording device according to claim 1,
wherein the detection unit is provided on a downstream side of the drying unit in a conveying direction.

10. The inkjet recording device according to claim 9,
wherein the ambient temperature is detected even during a temperature raising operation performed after the inkjet recording device is switched to the recording mode, and
a recording operation is started after the ambient temperature enters a target range.

11. The inkjet recording device according to claim 10, further comprising:
a heater for raising the ambient temperature in the recording device.

12. The inkjet recording device according to claim 9, further comprising:
a heater for raising the ambient temperature in the recording device.

13. The inkjet recording device according to claim 1,
wherein the ambient temperature is detected even during a temperature raising operation performed after the inkjet recording device is switched to the recording mode, and
a recording operation is started after the ambient temperature enters a target range.

14. The inkjet recording device according to claim 13, further comprising:
a heater for raising the ambient temperature in the recording device.

15. The inkjet recording device according to claim 1, further comprising:
a heater for raising the ambient temperature in the recording device.

16. The inkjet recording device according to claim 1, further comprising:
at least one of an air intake unit that takes external air into the device or an exhaust unit that discharges air to the outside from the inside of the device,
wherein in a case in which the ambient temperature is not in the target range, the control unit controls at least one of the amount of air taken in by the air intake unit or the amount of air discharged by the exhaust unit.

17. The inkjet recording device according to claim 1, further comprising:
a fixing unit that is provided on the downstream side of the drying unit in the conveying direction and performs processing for fixing the image by irradiation of ultraviolet rays,
wherein in the case where the ambient temperature is in the target range, the control unit switches the inkjet recording device to a recording mode in which a set intensity of the fixing unit is used as a target value corresponding to the time of recording from a standby mode in which set intensity of the fixing unit is used as a target value corresponding to the time of standby.

18. The inkjet recording device according to claim 17,
wherein the detection unit is provided on a downstream side of the fixing unit in the conveying direction.

19. The inkjet recording device according to claim 17,
wherein in a case in which the ambient temperature is not in the target range, the control unit controls at least one of the set temperature of the drying unit or the set intensity of the fixing unit.

20. The inkjet recording device according to claim 17,
wherein in a case where the last recording medium on which the image has been recorded is conveyed from the drying unit or the fixing unit, the control unit changes the set temperature of the drying unit and the set intensity of the fixing unit to settings that correspond to the time of the standby mode.

* * * * *